United States Patent [19]

Theurer

[11] 3,949,678

[45] Apr. 13, 1976

[54] METHOD FOR TAMPING AND LEVELING TRACK

[75] Inventor: Josef Theurer, Vienna, Austria

[73] Assignee: Franz Plasser Bahnbaumaschinen-Industriegesellschaft m.b.H., Vienna, Austria

[22] Filed: Dec. 19, 1974

[21] Appl. No.: 534,182

Related U.S. Application Data

[62] Division of Ser. No. 458,580, April 8, 1974, Pat. No. 3,895,583.

[30] Foreign Application Priority Data

May 25, 1973 Austria ..... 4627/73

[52] U.S. Cl. ..... 104/12; 104/7 R

[51] Int. Cl.[2] ..... E01B 27/17

[58] Field of Search ..... 104/1, 7, 8, 12, 7 R

[56] References Cited

UNITED STATES PATENTS

| | | | |
|---|---|---|---|
| 3,605,626 | 9/1971 | Stewart | 104/12 |
| 3,807,311 | 4/1974 | Plasser et al. | 104/12 |

*Primary Examiner*—Robert R. Song
*Assistant Examiner*—Richard A. Bertsch
*Attorney, Agent, or Firm*—Kurt Kelman

[57] ABSTRACT

In a mobile track tamping and leveling machine a controlled degree of ballast compaction is obtained at each tie in proportion to the track level error by connecting a pressure control valve to a track level error pickup and transmitting device to control the pressure on the tamping tools continuously in proportion to a maximum error signal received from the device while the track is held at the leveled position by a reference against upward pressure of the tampered ballast.

1 Claim, 6 Drawing Figures

VG
VG₀
Δf
P
P₀
S
P₁
P₂
P₃
P₄
P₅
P₆
P₇
0

METHOD FOR TAMPING AND LEVELING TRACK

This is a division of Ser. No. 458,580, filed Apr. 8, 1974, now U.S. Pat. No. 3,895,583, dated July 22, 1975.

The present invention relates to improvements in track surfacing operations, and more particularly in the tamping and leveling of a track consisting of rails mounted on ties, the rails and ties intersecting at points spaced in the direction of elongation of the track and the ties resting on ballast. The elongated edges of adjacent ones of the ties define cribs therebetween, and the track is leveled or graded in relation to a reference system.

In known track leveling methods, it has been proposed to tamp the ballast under the ties, particularly at the points of intersection of rails and ties, by exerting vibratory pressure on the ballast until the track was raised to the desired level determined by the reference system. It has been found that a long track section surfaced according to this method settles after a relatively short time back to its original uncorrected level under the load of trains traveling thereover, particularly at rail abutment points. It has been attempted to overcome this disadvantage by raising the track at such points above the desired level so that, after it has been depressed, it reaches the desired level. Various other means and methods have been tried but none has avoided or sufficiently reduced the settling of the corrected track to assume after a relatively short time most of its original level errors.

In U.S. patent applicantion Ser. No. 268,814, filed July 3, 1972, now U.S. Pat. No. 3,807,311, dated Apr. 30, 1974, of which I am one of the joint inventors, it has been proposed to control the tamping pressure in response to the condition of the track, for instance its geometric position in an effort to obtain uniform compaction of the ballast. This system takes into account the expected settling of the track after the surfacing operation and produces an improvement by the uniform compaction of the ballast.

In U.S. Pat. No. 3,595,170, dated July 27, 1971, it has been proposed to hold the track at a leveled position determined by a track level reference system to prevent the track from being pressed further upwardly above this level while tamping the ballast under the ties.

It is the primary object of the present invention to improve on these track tamping and leveling systems so that the leveled track really remains in the leveled position for a long time and after extended train traffic thereover by avoiding or at least considerably reducing differential settling of the corrected track.

This invention is based on the new discovery that the permancy of a track level and the avoidance of its uneven settling after correction depends importantly on the correlation of the degree of ballast compaction with the original track level error at each tie. Therefore, the invention proposes to control the degree of compaction of the ballast under each tie in proportion to a maximum track level error at the tie, to hold the track at a desired level determined by the reference system, and to continue the tamping to press the track upwardly while being held at the desired level so that zones of ballast compaction porportional to the track level error at each tie are continuously produced along a long track section.

In this manner, those track points which have been conventionally subject to uneven settling are supported more strongly by a higher compaction of the ballast thereunder, the ballast compaction or density under these points being proportionally greater than that under those track points which required less correction during the surfacing operation and thus proved to need less support against undue settling. The succession of zones of different compaction along the entire track section produces a continuous track support of great permanency to hold the track at the corrected level to a high degree of accuracy.

In a mobile track tamping and leveling machine which comprises a vertically adjustable tamping tool assembly including reciprocating and vibratory drive means for exerting pressure on the tamping tools to tamp the ballast under respective ones of the ties, a track lifting means, a track level reference system, a track level error pickup and transmitting device associated with the reference system to sense any error and to convert the sensed error into an electrical error signal proportional to the sensed error, and a control connected to the device and receiving the proportional error signals therefrom, the present invention provides the improvement of the control comprising a control circuit including a pressure control valve connected to the track level error pickup and transmitting device and operative to control the pressure on the tamping tool continuously in proportion to a maximum error signal received from the device, combined with a track holding device holding the track at the leveled position determined by the reference system against any upward pressure of the tamped ballast.

The control of this invention is very simple and according most reliable in operation since it responds merely to the track level error signals conventionally picked up and transmitted in track leveling operation, storing each maximum error signal to control the leveling of the track and the compaction of the ballast.

In a preferred embodiment of the invention, a circuit element, such as a limit switch operated by the vertical movement of the tamping tool assembly, is arranged to block transmission of the error signal to a storage unit which receives the electrical error signals from the track level error pickup and transmitting device. The storage unit stores only the error signal porportional to the maximum track level error sensed, i.e. the error signals sensed during the raising of the track at each tie are not stored due to the blocking of the transmission of these signals. Thus, only the maximum error signal is stored and used for the control. The same result maybe accomplished very simply by using a servo motor in the control circuit for operation of the pressure control valve.

The above and other objects, advantages and features of the present invention will become more apparent from the following detailed description of certain now preferred embodiments thereof, taken in conjunction with the accompanying drawing wherein FIG. 1 is a schematic side elevational view of a generally conventional ballast tamping and track leveling machine incorporating the control system of this invention;

Figures 1, 2, 3, 4:
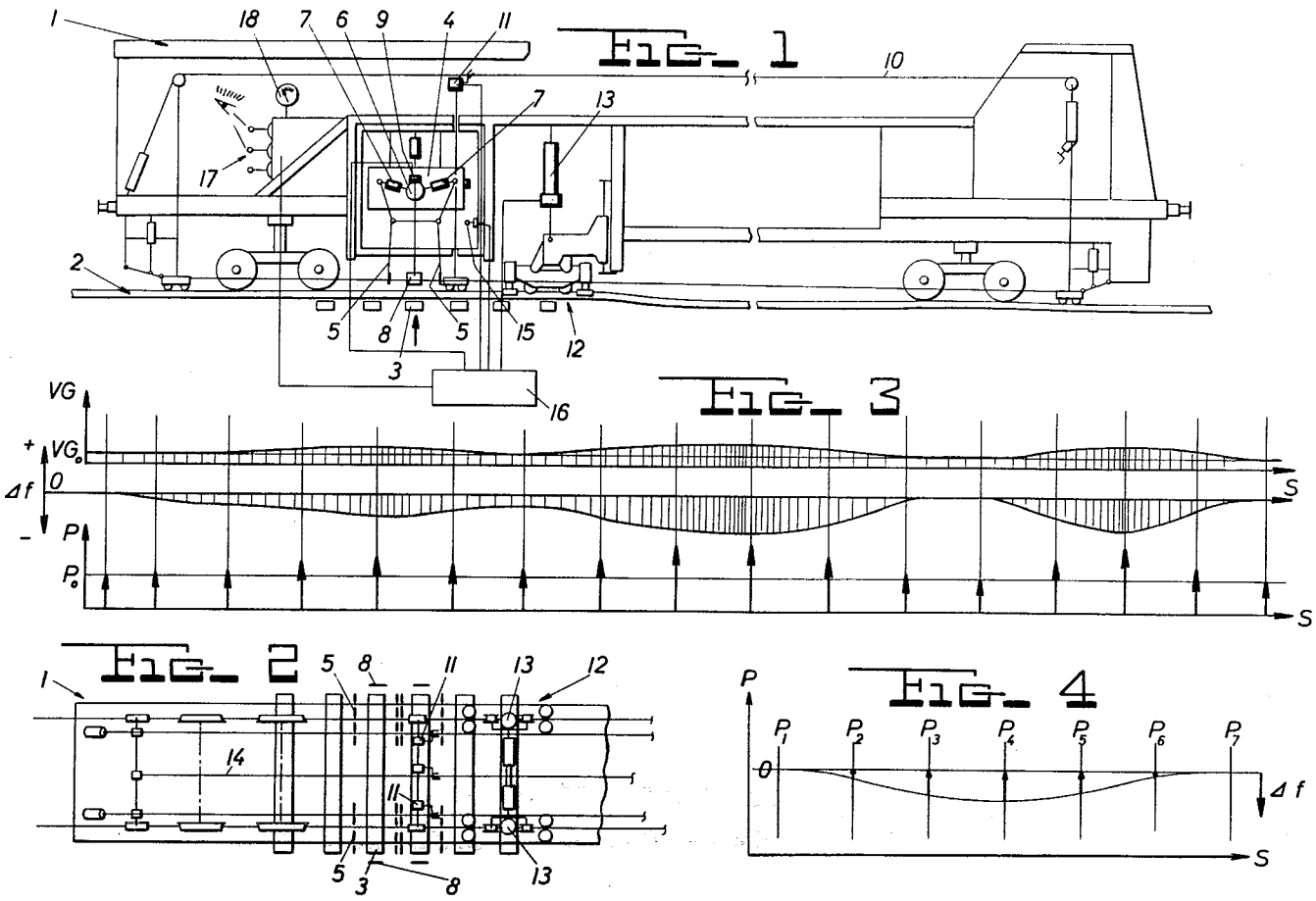
FIG. 2 is a schematic top view of a portion of the machine.
FIG. 3 is a graph illustrating the track position errors, the tamping pressures and the degree of ballast compaction obtained according to the invention along a length of track, the showing being considerably distorted in the direction of track elongation.
FIG. 4 is a graph showing respective track level errors and the tamping pressures corresponding thereto.

Referring now to the drawing and first to FIGS. 1 and 2, there is shown a generally conventional mobile ballast tamping and track leveling machine 1 whose elongated frame is supported on undercarriages spaced apart to provide a long wheel base and running on a track constituted by rails 2 and ties 3, the track ties resting on ballast (now shown). The machine includes a first reference system including tensioned wire 10 extending from an end point in an uncorrected track section to an end point in the corrected track section. The end points of the tensioned wire are supported on bogies running on the track and to measure the level of the track relative to reference wire 10, track level signal pickup and transmitter 11 cooperates with the wire, such as a rotary coil or potentiometer which has a forked pivotal element engaging the wire. A second reference system includes tensioned wire 14 for controlling the lining of the track. All of these structures and their operation, as well as the tamping arrangement hereinbelow described, are well known in track surfacing operations and, therefore, require no further explanation herein.

The tamping tool assembly or unit illustrated herein comprises tamping tool carrier 4 which is mounted on the machine frame for vertical movement by means of a hydraulic motor so that the tamping tools 5 and 9 may be displaced from an inoperative position above the track into an operative or tamping position wherein the jaws of the tamping tools on the lower ends thereof are immersed in the ballast underneath the ties 3. The illustrated tamping tool assembly comprises pairs of opposed vibratory tamping tools 5 which are arranged to enter the cribs between ties 3 so that, upon reciprocation by hydraulic drives 7 in the direction of track elongation, the opposed tools tamp or compact the ballast underneath the tie positioned between the opposed tools. While the tamping tools are reciprocated, they are also vibrated by drive 6, all in a well known manner.

The tamping tool assembly also includes additional vibratory tamping tools 8 arranged for immersion in the ballast adjacent the ends of ties 3 (see FIG. 2) and for reciprocation by drive 9 in a direction transverse to the direction of track elongation, i.e. towards the tie ends in the longitudinal direction of the ties. Nonsynchronous reciprocation of tamping tools 5, such as shown, for instance, in U.S. Pat. No. 3,357,366, dated Dec. 12, 1967, is preferred and the end tamping tools 8 serve to prevent lateral escape of the compacted ballast, thus assuring solid tamping at the points where the track rails rest on the ties.

As is indicated in broken lines in FIG. 2, the tamping tool unit may also comprise two pairs of opposed tamping tools for simultaneously tamping two adjacent ties, as described, for examples, in U.S. Pat. Nos. 3,357,366 and 3,372,651, dated Mar. 12, 1968.

The machine frame also carries a track lifting unit 12 which may be of any suitable design, the illustrated mechanism including pairs of flanged rail-gripping rollers engaging each rail 2 and mounted on a carrier which may be vertically movable by hydraulic drive 13.

The track lifting unit serves also to hold the track at a given level, as is also well known, the track lifting and holding unit being spaced sufficiently closely to the tamping unit to avoid excessive upward pressure beyond the desired track level by the tamped ballast. When the hydraulic drive 13 is locked so that unit 12 holds the track in position, it will resist further upward pressure against the track by ballast being compacted under the ties. If desired, the track could also be held at a leveled position against upward pressure from tamped ballast by mounting a track holding unit or track shoe in the region of the tamped tie or ties to exert a downward or counter pressure on the track at this point, such as disclosed, for instance, in U.S. Pat. No. 3,595,170, dated July 27, 1971.

All of the above described structure and its operation are generally conventional and, as is also known, lining of the track may be effected in respect of second reference system 14 by unit 12 which also carries laterally movable rail gripping rollers.

In accordance with this invention, maximum tamping pressure control 16 is connected not only to the reciprocating drives 7 and 9 for tamping tools 5 and 8, as well as to the vibratory tamping tool drive 6, but also to drive 13 for the vertical movement of track lifting unit 12, reference signal pickup and transmitter 11, and limit switch 15 mounted on the machine frame in the path of vertically movable tamping tool carrier 4 to be tripped thereby. Control 16 will be described hereinafter in connection with FIGS. 5 and 6, and it may be manually operated and adjusted by means of manual switch 17 by an operator viewing instrument panel 18.

Figure 5:
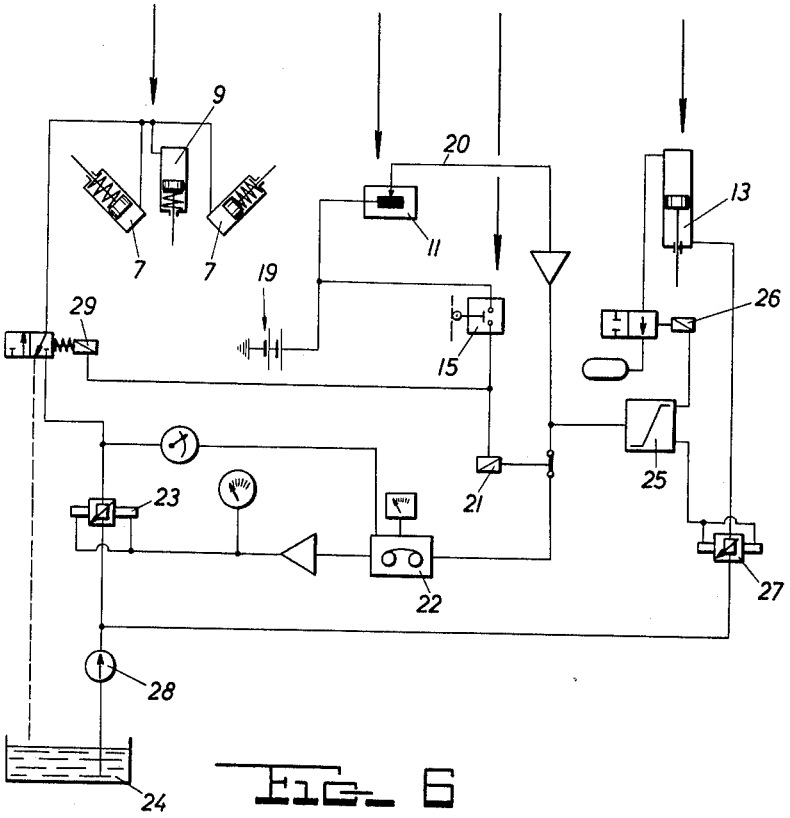
FIG. 5 is a simplified circuit diagram of the control according to the present invention.

FIG. 5 is a simplified circuit diagram of control 16. The level reference signal pickup and transmitter 11 is energized by voltage source 19, to which it is connected, and emits a reference signal whose voltage is proportional to the track level error sensed by transmitter 11 in respect to reference 10. In other words, if the transmitter is a rotary potentiometer, for instance, whose shaft is rotatable in response to the pivotal movement of a forked member engaging reference wire 10, the error signal voltage will change in response to the vertical movement of the transmitter, the latter being mounted on a rod which rides on the track rail and thus moves up and down as the track rail level changes. The signal pickup and transmitter constitutes the input of control 16 delivering an error input signal to signal storage unit 22, conductor 20 connecting transmitter 11 to one contact of relay 21 of the storage unit and an amplifier in the conductor amplifying the signal on its way to storage unit 22. Signal storage unit 22 is arranged to store always the last received largest error signal and its output is connected to pressure control valve 23, the signal from the storage unit to the control valve being amplified again. control valve 23 may be an electr-hydraulic servo valve and serves as adjustment element in control 16. Servo valve 23 is mounted in the hydraulic fluid supply conduit between hydraulic fluid tank 24 and reciprocating hydraulic drives 2 and 9 of the tamping tools. It thus controls the tamping pressure in response to the error signal transmitted to valve 23 from storage unit 22 and this, in turn, is proportional to the maximum track level error sensed by device 11 as the machine moves along the track.

A branch conductor leads from conductor 20 to gate or threshold switch 25 so that any zero error signal transmitted by reference signal pickup and transmitter 11 will energize electro-hydraulic control element 26 which operates as a check valve. The check valve is mounted in the hydraulic fluid conduit leading to one chamber of hydraulic drive 13 and, when energized by a zero error signal, it will prevent flow of hydraulic fluid to and from these chamber of drive 13, thus holding track lifting unit 12 in a fixed vertical position, i.e. holding the track at the desired level indicated by the zero error signal.

In the illustrated embodiment, gate 25 has a second output transmitting a signal to another adjustment element also constituted by an electro-hydraulic servo valve 27. Valve 27 is mounted in the hydraulic fluid supply conduit between the hydraulic fluid tank and the other chamber of drive 13. A constant speed delivery pump 28 is mounted in the hydraulic fluid supply conduits leading to drives 7, 9 and 13 to deliver the fluid thereto for operation of the drives.

The above described apparatus operates as follows:

The track level error signal coming from reference signal pickup and transmitter 11 is stored in unit 22 until limit switch 15 is tripped by the vertical downward move of tamping tool carrier 4 to initiate ballast tamping. When switch 15 is operated, it energizes relay 21 connected to the switch and thus interrupts further transmission of signals from device 11 to unit 22. At this point, the last stored error signal corresponding to the largest track level error detected and stored in unit 22 is transmitted to valve 23 which controls the hydraulic fluid pressure in the supply conduit to drives 7 and 9 in proportion to that error signal, i.e. according to the maximum error in the track level which must be corrected.

Limit switch 5 is also connected to electro-hydraulic valve 29 which is mounted in the hydraulic supply conduit, this valve being opened when the limit switch is tripped to permit fluid to flow into the drive cylinders and closed when the limit switch is open so that no hydraulic fluid flows to the tamping tool reciprocating drives when the tamping tool carrier is in its upper or inoperative position.

When valve 29 is open and the tamping tool reciprocating drives are operated, the ballast will be tamped or compacted underneath ties 3 at a pressure proportional to the maximum lifting stroke required, i.e. the maximum error signal transmitted by device 11 and stored in unit 22. The tamped ballast will press the track upwardly against the track holding unit 12 until compacted ballast zones proportional to the level error will be produced, as shown in the upper portion of the graph of FIG. 3 to be described hereinafter.

If the maximum error signal coming from reference signal pickup and transmitter 11 is smaller than that set at the second output of gate 25, drive 13 will not be operated at all, i.e. the lifting of the track for purposes of correcting the level error will be effectuated only by tamping the ties, as shown schematically in FIG. 1 by the vertically upward pointing arrow under the tie being tamped. However, if the error signals exceeds the set parameter, for instance a signal proportional to a level error of ¼ inch, the second output of gate 25 will transmit a signal to servo valve 27, thus opening the hydraulic supply conduit leading to the other cylinder chamber of drive 13 and causing track lifting unit 12 to raise the track to the desired level.

Regardless of the size of the maximum error signal determined by local track conditions and transmitted by device 11, gate 25 assures blocking of drive 13 when the desired track level has been reached so that the track is held fixed at this level. When the hydraulic fluid pressure controlled by valve 23 has been reached, tamping is concluded, tamping tool carrier 4 is lifted, thus opening limit switch 15, and valve 29 is closed to interrupt further supply of hydraulic fluid to drives 7 and 9. Furthermore, the opened limit switch causes relay 21 to connect storage unit 22 again with reference signal transmitter 11 so that, when the machine advances to the next tie to be tamped, the maximum level error may again be detected and the proportional error signal stored in unit 22.

The circuit diagram has been presented in FIG. 5 is simplified form to facilitate the basic understanding of the principles of the control. As shown, the control valve 23 may also be connected in a control circuit coupling the valve back to storage unit 22 or to a comparator.

Figure 6:
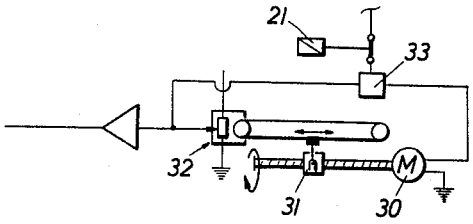
FIG. 6 shows a modification of such a control.

FIG. 6 illustrates a modification of one portion of control 16. This modified control operates as follows:

The relay 21, which receives the error signal in the same manner as in the embodiment of FIG. 5, is connected to servo-operated motor 30 to operate the same in response to such error signal. Operation of the motor rotates a threaded spindle which carries nut 31, thus moving the nut in proportion to the emitted error signal. Nut 31 is operatively connected with electrical signal transmitter 32, for instance a rotary potentiometer, the illustrated connection being a cable drive. The signal from transmitted 32 is amplified and transmitted to valve 23 for control thereof in the manner and for the purpose hereinabove described. To assure the proper adjustment of nut 31 by motor 30, potentiometer 32 is connected by a feedback circuit to register or compartor 33. In this manner, the position of nut 31 may be adjusted in proportion to the error signal coming from transmitter 11 and the operation of motor 30 accordingly adjusted.

It would also be possible, however, to connect reference signal pickup and transmitter 111 to a step-by-step motor. If motor 30 is constituted by such a motor, the feedback circuit could be avoided.

The advantages of track surfacing according to the present invention will become more apparent from a consideration of FIG. 3, the distances in the direction of track elongation being shown along horizontal axis S (considerably magnified).

The center diagram shows the track level of a long track section which has been condensed in its longitudinal extension for purposes of illustration, the level errors $\Delta f$ along the vertical axis of the graph showing the deviations from the desired or zero level of the track. To achieve uniform settling of the track after the tamping and leveling operation, the invention provides control of the tamping pressure, i.e. the termination of the operation of reciprocating tamping tool drives 7 and 9, in response to, or as a function of, the magnitude of level errors $\Delta f$.

The lower portion of the graph shows the tamping pressures P, i.e. the pressures exerted by drives 7 and 9 on tamping tools 5 and 8, which are proportional to the level errors $\Delta f$ at the indicated, selected points of the track section, these pressures being represented for ready understanding by vertically upward pointing arrows. The pressure level $P_o$ corresponds to the minimum tamping pressure used to tamp the ballast under those ties which are at or near the zero or desired level.

The upper diagram in the graph of FIG. 3 shows that the tamping pressures proportional to the respective level errors produce a continuous compacted ballast zone proportional to the respective level errors, with different degrees VG of ballast compaction, a minimum degree of compaction $VG_o$ being achieved at those ties which were at or near zero level.

Settling of the track due to the loads to which the ballast under the track is subjected is influenced primarily by the pressure under which the ballast has been compacted or tamped but it depends also on the amount, the porosity and the density of the ballast, as well as the corrected level of the track. Particularly the first load to which the corrected track is subjected causes usually a considerably and permanent deformation of the corrected track while subsequent deformations are essentially proportional to the logarithm of the number of the loads, for instance the undercarriages running over the track. Experiments have also shown that changes in the ballast density below the ties, which are also caused by train traffic, are also essentially equal to the logarithm of the total load.

Since any change in the density of compaction of the ballast under the ties also depends essentially on the amount of the ballast to be tamped, which is essentially proportional to the level error $\Delta f$, I have found that it is important to tamp the ballast underneath the ties in proportional dependence on the required lifting stroke. Thus, the ballast under a tie which must be lifted higher, i.e. at a point of a larger level error, must be tamped to a degree proportionally higher than is used for the tamping pressure of a tie located at a level closer to zero level so that a proportionally larger or smaller compaction or density of the ballast is achieved. Settling of a long track section under the load of train traffic can be made more or less uniform, or uneven settling may be at least considerably reduced, by a track surfacing operation producing a continuous compacted ballast zone whose local compaction is proportional to the track level due to different degrees of ballast compaction pressures proportional to the respective track level errors. For instance, those portions of the corrected track section where larger amounts of ballast have been tamped under the ties because of the large track level errors will settle less and usually slower in proportion to the original travel level error because of the higher degree of ballast compaction than those corrected track section portions where smaller amounts of ballast have been tamped at a lower pressure because of smaller track level errors.

Since changes in the ballast compaction or density due to train traffic depends on the amount of ballast packed under the ties, which in turn depends on the local travel level error, the track would settle differently along a long track section if the degree of compaction were the same along the entire track section. As will be seen from the graph of FIG. 3, proportional tamping pressures will produce zones of ballast compaction of different degrees proportional to the track level error. This will cause a substantially unfirm settling of the track section along its entire length.

Many means and methods are known to those skilled in the art to determine and measure the tamping pressure, the degree of compaction of the ballast and its density, such means and methods requiring no description for an understanding of the invention since they are conventional.

FIG. 4 is an enlarged graph of a portion of a long track section, the distances in the direction of track elongation being shown along horizontal axis S while the track level errors $\Delta f$ and the proportional tamping pressure P are shown along the vertical axis. The amounts of the difference between pressure $P_1$ and pressures $P_2$, $P_3$, etc. is indicated by the arrows.

As illustrated, the terminal tamping pressure at those points where the track is at or near zero level is about the same ($P_1$), this pressure being selected to correspond to the local ballast condition. Pressures $P_2$, $P_3$, etc., on the other hand, increase proportionally to the increase in track lever error $\Delta f$ until the maximum tamping pressure $P_4$ has been reached, which corresponds to the maximum track level error. At this point, the density of the compacted ballast is above that of the ballast under the ties at points $P_2$, $P_3$ or $P_5$, $P_6$. Despite the high tamping pressure at $P_4$, the track will stay at the desired track level determined by reference 10 since unit 12 will hold the track at this zero level against the upward pressure of the tamped ballast.

It will be clearly understood that the hereinabove described and illustrated track surfacing operation is not limited to the specific embodiments disclosed herein. For instance, various tamping units may be used and particularly uniform and good results will be obtained with a tamping assembly which enables the simultaneous tamping of two immediately adjacent ties. Also, while asynchronous hydraulic reciprocating drives for pairs of opposed tamping tools have been found most advantageous, any other suitable tamping means may be successfully used with the control of the invention which is defined by the appended claims.

What is claimed is:

1. In a method of obtaining a controlled degree of ballast compaction in the tamping and leveling of a track consisting of rails mounted on ties, wherein the ballast is tamped under each one of the ties and the track is leveled in relation to a reference system, the improvement of controlling the degree of compaction of the ballast under each tie in proportion to a maximum track level error at said tie, holding the track at a desired level determined by the reference system, and continuing the tamping to press the track upwardly while being held at the desired level so that zones of ballast compaction proportional to the track level error at each tie are continuously produced along a long track section.

* * * * *